US005853937A

United States Patent [19]

Asanae et al.

[11] Patent Number: 5,853,937

[45] Date of Patent: Dec. 29, 1998

[54] TWO-COMPONENT MAGNETIC DEVELOPER FOR PRINTING CHARACTERS FOR MAGNETIC INK CHARACTER RECOGNITION

[75] Inventors: Masumi Asanae, Kumagaya; Fumio Kimura, Isesaki, both of Japan

[73] Assignee: Hitachi Metals Ltd., Tokyo, Japan

[21] Appl. No.: 906,804

[22] Filed: Aug. 6, 1997

Related U.S. Application Data

[63] Continuation of Ser. No. 714,817, Sep. 17, 1996, abandoned.

[30] Foreign Application Priority Data

Sep. 22, 1995 [JP] Japan ..... 7-244181

[51] Int. Cl.[6] ..... G03G 9/083

[52] U.S. Cl. ..... 430/106.6; 430/105; 430/111

[58] Field of Search ..... 430/106.6, 105, 430/111

[56] References Cited

U.S. PATENT DOCUMENTS

| | | | |
|---|---|---|---|
| 4,847,176 | 7/1989 | Sano et al. | 430/106.6 |
| 4,861,693 | 8/1989 | Ohtani et al. | 430/106.6 |
| 5,406,357 | 4/1995 | Nakahara et al. | 355/245 |
| 5,439,772 | 8/1995 | Takagi et al. | 430/106.6 |
| 5,532,095 | 7/1996 | Asanae et al. | 430/106.6 |
| 5,547,795 | 8/1996 | Ochiai et al. | 430/106.6 |
| 5,554,479 | 9/1996 | Ochiai et al. | 430/122 |

FOREIGN PATENT DOCUMENTS

| | | |
|---|---|---|
| 6-282100 | 10/1994 | Japan . |
| 7-77827 | 3/1995 | Japan . |
| 7-77829 | 3/1995 | Japan . |

*Primary Examiner*—Marion McCamish
*Assistant Examiner*—Cheryl Juska
*Attorney, Agent, or Firm*—Morgan, Lewis & Bockius LLP

[57] ABSTRACT

A two-component magnetic developer of the invention for printing characters on documents for magnetic ink character recognition comprises the mixture of 20 to 80 percent by weight of a magnetic toner containing binder resin and magnetic powder and the balance being a magnetic carrier, wherein the magnetic toner has magnetic powder of 30 to 60 percent by weight, residual magnetization σr of 4 to 16 emu/g and average particle diameter of 5 to 15 um. The developer rarely causes background fogging and carrier adhesion on the developed images which is suitable for MICR.

10 Claims, No Drawings

TWO-COMPONENT MAGNETIC DEVELOPER FOR PRINTING CHARACTERS FOR MAGNETIC INK CHARACTER RECOGNITION

This application is a continuation of application Ser. No. 08/714,817, filed Sep. 17, 1996, now abandoned.

DETAILED DESCRIPTION OF THE INVENTION

1. FIELD OF THE INVENTION

This invention relates to a magnetic developer for electrostatic photography, electrostatic printing and/or electrostatic recording, particularly to a two-component magnetic developer suitable for printing magnetic characters for magnetic ink character recognition.

2. BACKGROUND OF THE INVENTION

In image development of a printer, a facsimile etc. using electrostatic photography or electrostatic recording, electrostatic latent image is formed on a cylindrical photosensitive or photoreceptor drum. A magnetic developer is transported to a developing region on the cylindrical photoreceptor drum by being attracted on a developing roll which has a rotary sleeve and a magnetic member positioned in the sleeve. The electrostatic latent image is rubbed by a magnetic brush of the magnetic developer and developed to a visible toner image at the developing region. After then, the visible toner image on the photoreceptor drum is transferred to a recording paper or a document and heat-fixed on it.

A variety of applications of electrostatic photography have been developed as image developing apparatuses have been popular. As an application of electrostatic photographic printer, magnetic ink character recognition (MICR) has been proposed.

In MICR system, information about drawing bank, amount, account number etc. is printed by magnetic ink on a document, such as personal check or bill that is effectively sorted by a magnetic reader at a clearing house. Formerly, offset printing with magnetic ink was widely used. But, there has been a stronger demand for a portable MICR character printer (MICR encoder).

A conventional MICR encoder is an impact printer, using thermographic copying, which is a single function machine to print MICR characters only, so that it can not be used to make an ordinal document. It has been desired that an electrostatic photographic printer has been developed which can print not only ordinal characters and/or graphics but magnetic characters with an improved MICR recognition.

When a conventional electrostatic photographic printer is used with a conventional magnetic developer as an MICR encoder, read-out error rate or reject rate in magnetic reading by an MICR reader/sorter is extremely increased over the MICR characters printed by an offset printing or impact printer. And the conventional electrostatic photographic printer with conventional magnetic developer can not be used in practice.

Documents with MICR characters are normally passed about 10 times through an MICR reader/sorter. The documents are rubbed rapidly by a magnetic head every time passed for magnetic reading. Accordingly, it is required that background fogging, image smearing, white spots or omission of characters does not occur in printed characters of a magnetic developer even when they are rubbed rapidly.

To decrease the reject rate in the MICR reader/sorter, it is necessary that the shapes and dimensions of the printed MICR characters are precisely, finely and accurately reproduced without any break.

However, image forming powder in a conventional magnetic developer that is prepared by a pulverization process has an average particle size of 6 to 13 um but a wide particle size distribution. It is a mixture of particles of a wide variety of shapes having broken edges and fine particles of submicron order. So, it has low fluidity and broad charge distribution. Since undesirable phenomena of low image density, background fogging and adhesion of carrier particles occur due to the reduction of triboelectric charge, reject rate in MICR reader/sorter tends to increase.

To solve the above problems, a polymeric toner containing a surface treated magnetic material and a magnetic toner having polyolefins of 0.01 to 0.5 um dispersion radius and residual magnetization σr of 4.0 to 7.0 emu/g were proposed in JPA 7-77827 and JPA 7-77829, respectively.

Since the proposed magnetic developers need polymerization process and dispersion process, the preparation processes are complicated as compared with a usual pulverization and an excellent recognition rate is difficult to obtain.

To develop characters for MICR, although a single component developer comprising only magnetic toner can be used, a two-component developer comprised of magnetic toner and magnetic carrier has been widely used. The reason is supposed that the two-component developer can more improve the triboelectrical chargeability in toner to reduce background fogging of toner as compared with the single component developer. The term "background fogging" means that toner adheres to an desired region (background) of the photoreceptor and as a result, document is smeared.

The two-component developer is normally the mixture of magnetic carrier particles of about 100 um diameter and magnetic toner particles of about 10 um diameter, which toner content in the developer mixture is less than 10 percent by weight, normally 3 to 5 percent by weight. The two-component developer is mixed on a cylindrical developing roll which has a permanent magnet inside, so that the surfaces of the magnetic toner particles are triboelectrically charged with the opposite polarity to the surfaces of the magnetic carrier particles. The magnetic toner particles adhere to the surfaces of the magnetic carrier particles due to the electrostatic and magnetic attraction forces. The developer mixture forms magnetic brushes along magnetic force lines from the permanent magnet positioned in the developing roll to rub with the magnetic brushes latent images formed on the photoreceptor and to stick the charged toner particles selectively on charged regions, or on uncharged regions in case of reversal development, of the latent images to develop the images.

The magnetic carrier particles in the two-component developer rarely adhere to the photoreceptor surface, because the magnetic carrier particles having about 100 um diameter is strongly attracted in the magnetic brushes by the magnet in the developing roll. It has been necessary to control the toner content in the developer mixture in which the consumed toner amount in the developer is measured and supplied to keep the toner content level. A developing process which does not need the toner control has been desired. Also, the carrier particles are coarse to rough the developed images and the toner even with charge enhancing agent is not triboelectrically charged enough to provide high density images.

SUMMARY OF THE INVENTION

It is an object of the invention to obviate the disadvantages in the prior art and to provide a two-component magnetic developer which is prepared by a usual pulverization process and by which an improved recognition rate or reduced reject rate can be obtained.

The two-component magnetic developer of the invention is suitable for use in printing characters for magnetic ink character recognition in which magnetic character information is read out by a magnetic reader/sorter.

A two-component magnetic developer of the invention for printing characters for magnetic ink character recognition comprises the mixture of 20 to 80 percent by weight of a magnetic toner containing binder resin and magnetic powder and the balance being a magnetic carrier, wherein the magnetic toner has magnetic powder of 30 to 60 percent by weight, residual magnetization σr of 4 to 16 emu/g and average particle diameter of 5 to 15 um.

The average particle diameter of the magnetic carrier for the invention is preferably 5 to 60 um. Too fine carrier particles tend to adhere to the photoreceptor surface since the attraction force of the carrier particles by the developing roll is too small, while coarse carrier tends to rough the developed image since they do not provide fine magnetic brushes. The coarse carrier particles have small specific surface area, so that toner particles are not sufficiently triboelectrically charged and the image density is reduced.

The magnetic carrier for the magnetic developer of the invention may be a resin carrier containing binder resin and magnetic powder. When the carrier has the triboelectric charge of the opposite polarity to that of the toner, the average particle diameter of the carrier is preferably 0.5 to 2 times that of the toner. When the carrier has the triboelectric charge of the same polarity as the toner, the average particle diameter of the carrier is preferably 1.5 to 4 times that of the toner.

The magnetic carrier may be prepared with any one of iron powder, ferrite and magnetite.

DESCRIPTION OF THE PREFERRED EMBODIMENTS

Examples of suitable toner resins selected for the toner and developer compositions of the invention include vinyl resins, epoxy resins, cross-linked silicone resins, colophony-added phenol resins, cellulose resins, polyether resins, polyesters, styrene/butadiene resins, polyurethane, polycarbonate resins, fluorocarbon polymers including polytetrafluoroethylene and mixtures thereof. Suitable vinyl resins may be selected as the toner resin including homopolymers or copolymers of two or more vinyl monomers. Typical vinyl monomers include styrene such as p-chlorostyrene and methyl styrene; vinyl halide such as vinyl chloride, vinyl bromide and vinyl fluoride; vinyl acetate, vinyl propionate, vinyl benzoate and vinyl butylate; vinyl esters of monocarboxylic acids such as methyl acrylate, ethyl acrylate, n-butylacrylate, isobutyl acrylate, dodecyl acrylate, n-octyl acrylate, 2-chloro ethyl acrylate, phenyl acrylate, methyl alpha-chloro acrylate and butyl methacrylate; acrylonitrile, methacrylonitrile, and acrylamide; vinyl ether such as vinyl methyl ether, vinyl isobutyl ether and vinyl ethyl ether; and vinyl ketones such as vinyl ethyl ketone, vinyl hexyl ketone and vinyl isopropenyl ketone.

Examples of magnetic powder for the magnetic toner include magnetite and soft ferrite powder of from 30 to 60 percent by weight. Residual magnetization σr of the magnetic toner is 4 to 16 emu/g. If the content of the magnetic powder is less than 30 percent, the residual magnetization of the toner will be reduced and the more toner will be scattered to cause background fogging. If the magnetic powder content is more than 60 percent, the toner fixability will deteriorate and the residual magnetization will increase to cause an increasing reject rate. The residual magnetization was measured by a vibration sample magnetometer, such as VSM-3™ from Tohei Industry Co.

The magnetic toner may contain a release agent of less than 10 percent by weight, such as polyolefin, pigment of suitable amount, such as carbon black, and lubricant agent as described below, as internal or external additives. When magnetite is selected as the magnetic powder, it is not necessary to add the pigment.

Examples of the lubricant agent include internal additives of 0.1 to 5 percent by weight, such as zinc stearate, poly fluoro vinylidene, and silicone vanish, and external additives of 0.1 to 2 percent by weight, such as zinc stearate, poly fluoro vinylidene, and hydrophobic silica. The excess of the lubricant agent effects poor fixability, while the poor amount of the lubricant agent results in image smearing.

In addition, charge enhancing agents or charge control agents, such as nigrosine and azo dye containing metal, may be added as an optional component. An average particle diameter of the magnetic toner is preferably 5 to 15 um to accomplish fine images, and the toner content in the magnetic developer is preferably 20 to 80 percent by weight. In the case of the toner content of less than 20 percent by weight in the two-component developer, the carrier particle amount without toner adhering thereto is increased in the magnetic brushes to cause a large amount of the carrier particles to rub the photoreceptor surface and to adhere to it. In the case of the toner content of more than 80 percent by weight, the amount of free toner particles which are not captured by carrier particles is increased to cause toner scattering and background fogging. The average particle diameter was measured by a particle distribution meter, such as Coulter Counter Model TA-11 from Coulter Electronics.

The specific volume resistivity of the magnetic toner is preferably insulating, that is higher than $10^{14}$ ohm-cm, to improve transferability. The toner is triboelectrically charged, with absolute value of the triboelectric charge of more than 10 microcoulombs per gram preferably, when mixed with magnetic carrier or agitated by a doctor blade.

Examples of the magnetic carrier include magnetic metal powder, such as iron powder, magnetic oxide powder, such as ferrite and magnetite, with or without coating of resin material on the surface, and binder type particles with magnetic powder dispersed in resin binder.

Magnetization $\sigma_{1000}$ of the carrier particles in magnetic field of 1000 Oersteds is preferably 30 to 50 emu/g. $\sigma_{1000}$ of less than 30 emu/g is not desirable since the carrier particles tend to adhere to the photoreceptor surface. When $\sigma_{1000}$ is more than 50 emu/g, a larger torque is required to transport the magnetic developer and a larger amount of the carrier is spent to make a life short and background fogging is caused.

The specific volume resistivity of the magnetic carrier is preferably more than $10^4$ ohm-cm. The magnetic carrier of less than $10^4$ ohm-cm tends to adhere to the photoreceptor to degrade the image and to leak at an electric charger. The low resistivity carrier tends to less charge the toner on mixing and developing.

The magnetization was measured with a vibration sample magnetometer, such as VSM-3 by Toei Industry. The specific volume resistivities were measured by an insulating resistance meter, such as Model 4329™ of Yokogawa Hewlett Packard in an electric field of DC 100 V/cm for carrier and DC 4000 V/cm for toner with 10 some mg sample filled in a Teflon® cylinder of 3.05 mm inside diameter under 0.1 Kg pressure. The triboelectric charge of the toner was measured by a blow-off powder charge meter, such as TB-200™ of Toshiba Chemical with the toner that was mixed with ferrite carrier, such as KBN-100™ of Hitachi Metals to have toner content of 5 percent by weight and blown with a blowing pressure of 1.0 Kgf/cm$^2$.

EXAMPLE

Magnetic toners were prepared as follows:

(a) Magnetic toners were prepared by mechanical blending 20 to 70 parts by weight of magnetite EPT 500™ of Toda, 3 parts of polypropylene TP32™ of Sanyo Chemical, 2 parts of charge enhancing agent Bontron E81™ of Orient Chemical, 0, 1, 1.5, 2.5, 5 and 6 parts of zinc stearate and the remainder being styrene n-butyl methacrylate (Mw: $21\times10^4$, Mn: $1.4\times10^4$), melt-blending at 150 to 190 degrees centigrade and cooling. The mixed materials were coarsely broken by an attritor, followed by pulverization by a jet mill. The toners were classified to an average particle diameter of 10 um and had a triboelectric charge of −21 microcoulombs per gram.

(b) Magnetic toner was prepared by repeating the procedure (a) with the exception that 44 parts by weight of styrene n-butyl methacrylate, 50 parts of magnetite, 3 parts of polypropylene, 2 parts of charge enhancing agent, all of which are the same materials as in (a), and 1 part of poly fluoro vinylidene were selected.

(c) Magnetic toner was prepared by repeating the procedure (a) with the exception that 1 part by weight of silicone vanish was used as additive. Magnetic toners (b) and (c) had the same average particle size and the same triboelectric charge as the magnetic toner (a).

(d) Magnetic toners were prepared by repeating the procedure (a) with the exception that 50 parts by weight of styrene n-butyl methacrylate, 45 parts of magnetite, 3 parts of polypropylene and 2 parts of charge enhancing agent, all of which are the same materials as used in (a), were selected. 0.2, 1, 2 and 2.5 parts by weight of zinc stearate were added as an external additive to the toner. The toners had the average particle size of 10 um and the triboelectric charge of −21 microcoulombs per gram.

(e) Magnetic toner was prepared by the process (d), except that 0.5 parts by weight of poly fluoro vinylidene was used as an external additive.

(f) Magnetic toner was prepared by the process (d), except that 0.5 parts by weight of titanium oxide was used as an external additive.

(g) Magnetic toner was prepared by the process (d), except that 0.5 parts by weight of hydrophobic silica Aerosil R972™ of Nippon Aerosil was used as an external additive.

(h) Magnetic toner was prepared by the process (g), except that 55 parts by weight of styrene n-butyl methacrylate and 40 parts of magnetite were selected. Magnetic toners of (e) through (h) had the same average particle diameter and the same triboelectric charge as the magnetic toner (d).

Magnetic carriers were prepared as follows:

(A) Positively charged magnetic carriers of binder type were prepared by mechanical blending 47 parts by weight of styrene n-butyl methacrylate (Mw: $23\times10^4$, Mn: $1\times10^4$), 50 parts of magnetite EPT500™ of Toda and 3 parts of charge enhancing agent BONTRON No. 3™ of Oriental Chemical, heat-mixing and cooling. The mixed materials were pulverized by a ball mill and classified to average particle diameters of 8, 12, 20 and 25 um. The specific volume resistivity was $2\times10^{15}$ ohm-cm.

(B) Negatively charged magnetic carrier of binder type having specific volume resistivity of $3\times10^{15}$ ohm-cm and average particle diameters of 10, 15, 25, 40 and 45 um were prepared by repeating the process (A), with the exception that 40 parts by weight of polyester FC433™ of Mitsubishi Petrochemical and 60 parts of magnetite EPT500™ of Toda were selected.

(C) Negatively charged magnetic carrier of binder type having specific volume resistivity of $1\times10^{13}$ ohm-cm and average particle diameter of 30 um was prepared by repeating the process (B), with the exception that 30 parts by weight of polyester and 70 parts of magnetite were selected.

(D) Magnetic carrier with specific volume resistivity of $1\times10^9$ ohm-cm was prepared by coating 100 parts by weight of flat iron powder, the average particle diameter: 50 um and the saturation magnetization σs: 190 emu/g, with 7.5 parts of silicone resin SR2410™ of Toray Silicone.

(E) Magnetic carrier with specific volume resistivity of $1\times10^8$ ohm-cm was prepared with spherical ferrite powder having average particle diameter of 30 um and saturation magnetization σs of 55 emu/g.

(F) Magnetite with average particle diameter of 60 um was prepared by mixing 100 parts by weight of fine magnetite powder having average particle diameter of 0.3 um and 160 parts of an aqueous solution containing 10 parts of polyvinylalcohol by an attritor to make slurry. The mixed materials were spray dried to particulate. The particles were sintered in a nitrogen atmosphere at 1100 degrees centigrade for 2 hours and reduced in a hydrogen atmosphere at 600 degrees centigrade, followed by classifying. Magnetic carrier having specific volume resistivity of $5\times10^8$ ohm-cm was prepared by coating 100 parts by weight of the magnetite with 7.5 parts of silicone resin. The silicone resin was the same material as used in the process (D).

The two-component magnetic developers containing toner of 10 to 90 percent by weight were prepared by mixing the aforementioned magnetic toners and magnetic carriers. MICR characters were printed by the magnetic developers according to JIS C 6251-1980 and read magnetically by a commercially available MICR reader/sorter, such as IBM 3890™. The evaluation results of print/read by the magnetic developers are shown in Tables 1 to 3.

In the evaluation, a photoreceptor drum was provided with OPC which surface voltage was −500 V and rotation speed was 100 mm/sec. A developing roll was comprised of a cylindrical sleeve of stainless steel (AISI 304) having an outside diameter of 20 mm and rotation speed of 600 mm/sec and a permanent magnet member asymmetrically magnetized with 5 poles (magnetic flux densities on the surface: 800 Gausses at main pole and 700 Gausses at other poles) and fixed in the sleeve. The developing gap between the photoreceptor and the developing roll was 0.4 mm and the doctor gap between the photoreceptor and the doctor blade was 0.25 mm. Biasing voltage of −400 V was applied to the sleeve. The developed images were transferred to personal checks by a corona discharger and fixed on them by a heat roll at 180 degrees centigrade under pressure of 1 Kg/cm.

TABLE 1

| | Magnetic Toner | | | | Mag Carrier | | | Image Quality | | | |
|---|---|---|---|---|---|---|---|---|---|---|---|
| No. | Toner Type | Magnetite wt. part | Lubricant wt. part | Residual Magnetization emu/g | Carrier Type | Av. Particle Dia. um | Toner Content wt. % | Image Density | Background fogging | Smear | Read-out Error Rate |
| 1 | a | 20 | 1 | 3 | A | 12 | 40 | 1.52 | X | X | 8/10 Note:1 |
| 2 | a | 30 | 1 | 5 | A | 12 | 40 | 1.48 | ○ | ○ | 0/10 |
| 3 | a | 40 | 1 | 6.4 | A | 12 | 40 | 1.42 | ○ | ○ | 0/10 |
| 4 | a | 60 | 1 | 10 | A | 12 | 40 | 1.32 | ○ | ○ | 0/10 |
| 5 | a | 70 | 1 | 18 | A | 12 | 40 | 1.07 | ○ | ○ | 9/10 Note:2 |
| 6 | a | 50 | 0 | 8 | A | 12 | 40 | 1.38 | ○ | X | 3/10 |
| 7 | a | 50 | 2.5 | 8 | A | 12 | 40 | 1.32 | ○ | ○ | 0/10 |
| 8 | a | 50 | 5 | 8 | A | 12 | 40 | 1.39 | ○ | ○ | 0/10 |
| 9 | a | 50 | 6 | 8 | A | 12 | 40 | 1.32 | X | X | 7/10 |
| 10 | a | 50 | 1.5 | 8 | A | 8 | 40 | 1.41 | ○ | ○ | 0/10 |
| 11 | a | 50 | 1.5 | 8 | A | 20 | 40 | 1.3 | ○ | ○ | 0/10 |
| 12 | a | 50 | 1.5 | 8 | A | 25 | 40 | 1.18 | ○ | ○ | 2/10 |
| 13 | b | 50 | 1 | 8 | A | 12 | 40 | 1.35 | ○ | ○ | 0/10 |
| 14 | c | 50 | 1 | 8 | A | 12 | 40 | 1.38 | ○ | ○ | 0/10 |

Note:1 Low output
Note:2 Position detection error

Magnetite contents in the magnetic toners were varied in Nos. 1 through 5 of Table 1. Increasing magnetite contents causes to increase residual magnetization or but to reduce image density. No. 1 with low magnetite content resulted in a low residual magnetization and the background fogging and smearing were remarked to cause a high reject rate or read-out error rate. No. 5 with high magnetite content did not result in background fogging or smearing but the image density was too low and caused a high reject rate. By contrast, Nos. 2 through 4 provided clear images without background fogging or smearing and read-out error did not occur.

Nos. 6 through 9 varied zinc stearate contents in the magnetic toners. Toner used in No. 6 did not contain zinc stearate to cause image smearing and read-out errors. Toner used in No. 9, that contained too much zinc stearate, caused poor fixability and background fogging and image smearing to result in read-out error. Toners used in Nos. 7 and 8 provided clear images and no read-out error occurred. The additive content of 0.1 to 5 parts by weight is desirable.

Nos. 10 through 12 varied average particle diameters of magnetic carriers. Carrier used in No. 12 had 2.5 times toner average diameter of 10 um and caused low image density and read-out error. Carriers used in Nos. 10 and 11 resulted in excellent images and no read-out error. Since magnetic carrier with reduced average particle diameter tends to adhere to a photoreceptor surface, the average particle diameter of magnetic carrier is preferably more than 5 um, 0.5 to 2 times average diameter of the magnetic toner.

Magnetic toner used in Nos. 13 and 14 that contained poly fluoro vinylidene and silicone vanish as additives, respectively, instead of zinc stearate, resulted in clear images and no read-out error.

TABLE 2

| | Magnetic Toner | | | | Mag Carrier | | | Image Quality | | | |
|---|---|---|---|---|---|---|---|---|---|---|---|
| No. | Toner Type | Magnetite wt. part | Lubricant wt. part | Residual Magnetization emu/g | Carrier Type | Av. Particle Dia. um | Toner Content wt. % | Image Density | Background fogging | Smear | Read-out Error Rate |
| 15 | d | 45 | 0.2 | 8 | A | 12 | 40 | 1.35 | ○ | ○ | 0/10 |
| 16 | d | 45 | 1 | 8 | A | 12 | 40 | 1.40 | ○ | ○ | 0/10 |
| 17 | d | 45 | 2 | 8 | A | 12 | 40 | 1.38 | ○ | ○ | 0/10 |
| 18 | d | 45 | 2.5 | 8 | A | 12 | 40 | 1.42 | ○ | X | 4/10 |
| 19 | e | 45 | 0.5 | 8 | A | 12 | 40 | 1.40 | ○ | ○ | 0/10 |
| 20 | f | 45 | 0.5 | 8 | A | 12 | 40 | 1.38 | ○ | ○ | 0/10 |
| 21 | g | 45 | 0.5 | 8 | A | 12 | 40 | 1.39 | ○ | ○ | 0/10 |
| 22 | a | 45 | 1 | 8 | B | 10 | 40 | 1.49 | X | ○ | 10/10 |
| 23 | a | 45 | 1 | 8 | B | 15 | 40 | 1.47 | ○ | ○ | 0/10 |
| 24 | a | 45 | 1 | 8 | B | 25 | 40 | 1.42 | ○ | ○ | 0/10 |
| 25 | a | 45 | 1 | 8 | B | 40 | 40 | 1.40 | ○ | ○ | 0/10 |
| 26 | a | 45 | 1 | 8 | B | 45 | 40 | 1.22 | ○ | ○ | 5/10 |
| 27 | a | 45 | 1 | 8 | C | 30 | 40 | 1.40 | ○ | ○ | 0/10 |
| 28 | a | 45 | 1 | 8 | D | 50 | 40 | 1.35 | ○ | ○ | 0/10 |
| 29 | a | 45 | 1 | 8 | E | 30 | 40 | 1.38 | ○ | ○ | 0/10 |
| 30 | a | 45 | 1 | 8 | F | 60 | 40 | 1.32 | ○ | ○ | 0/10 |

Table 2 shows evaluation results of magnetic reading by using combinations of magnetic carrier (A) with magnetic toners (d) through (g) and magnetic carriers (B) through (F) with magnetic toner (a).

Magnetic toners (d) through (g) contained external additives on the toner surface. In No. 18 with high zinc stearate content, high image density was obtained but image smearing occurred to cause read-out error.

In Nos. 15 through 17, clear images were obtained and no read-out error occurred. Accordingly, external additive content is preferably 0.1 to 2 parts by weight. Toners used in Nos. 19 through 21 that contained poly fluoro vinylidene, titanium oxide and hydrophobic silica instead of zinc stearate showed excellent read-out results.

In Nos. 22 through 26, magnetic carrier (B) which was triboelectrically charged with the same polarity as the magnetic toner was used, instead of magnetic carrier (A) which had the opposite polarity to the magnetic toner and the average particle diameters of the magnetic carriers were varied. The magnetic carrier with reduced average particle diameter provided higher image density, but No. 22 caused a large amount of white spots due to adhesion of carrier particles to the photoreceptor and a background fogging due to toner scattering and effected almost all read-out errors. In No. 26 with large carrier diameter, image density was reduced to cause read-out errors. By contrast, in Nos. 23 through 25, excellent images were obtained to cause no read-out errors. Accordingly, the average particle diameter of the magnetic carrier is preferably 1.5 to 4 times that of the magnetic toner.

In Nos. 27 through 30, other magnetic carriers were used to result in excellent images and no read-out errors.

30 to 60 percent by weight, a residual magnetization ($\sigma_r$) of 4 to 16 emu/g, and an average particle diameter of 5 to 15 $\mu$m; and a magnetic carrier of binder particles with magnetic powder dispersed in a resin binder, the magnetic powder and the resin binder being mechanically blended and pulverized to form a mixture with an average particle diameter of 5 to 60 $\mu$m, wherein the magnetic toner is 20 to 80 percent by weight of the developer and the magnetic carrier is the balance and wherein the magnetic carrier of binder particles with magnetic powder dispersed in a resin binder has the triboelectric charge of the opposite polarity to that of the toner and the average particle diameter of 0.5 to 2 times that of the toner.

2. The two-component magnetic developer as set forth in claim 1, wherein magnetization $\sigma_{1000}$ of the magnetic carrier in magnetic field of 1000 Oesteds is 30 to 50 emu/g.

3. The two-component magnetic developer as set forth in claim 2, wherein the magnetic toner contains a release agent of less than 10 percent by weight.

4. The two-component magnetic developer as set forth in claim 2, wherein the magnetic toner contains internal additives of 0.1 to 5 percent by weight as a lubricant agent.

5. The two-component magnetic developer as set forth in claim 2, wherein the magnetic toner contains external additives of 0.1 to 2 percent by weight as a lubricant agent.

6. A two-component magnetic developer for printing magnetic characters for magnetic ink character recognition, the developer comprising:

a magnetic toner containing a binder resin and a magnetic powder, the magnetic toner having magnetic powder of 30 to 60 percent by weight, a residual magnetization

TABLE 3

| | Magnetic Toner | | | | Mag Carrier | | Toner | Image Quality | | | Read-out |
|---|---|---|---|---|---|---|---|---|---|---|---|
| No. | Toner Type | Magnetite wt. part | Lubricant wt. part | Residual Magnetization emu/g | Carrier Type | Av. Particle Dia. um | Content wt. % | Image Density | Background fogging | Smear | Error Rate |
| 31 | h | 40 | 0.5 | 6.4 | E | 30 | 10 | 1.35 | ○ | ○ | 0/10 Note:3 |
| 32 | h | 40 | 0.5 | 6.4 | E | 30 | 20 | 1.40 | ○ | ○ | 0/10 |
| 33 | h | 40 | 0.5 | 6.4 | E | 30 | 60 | 1.42 | ○ | ○ | 0/10 |
| 34 | h | 40 | 0.5 | 6.4 | E | 30 | 80 | 1.47 | ○ | ○ | 0/10 |
| 35 | h | 40 | 0.5 | 6.4 | E | 30 | 90 | 1.55 | X | ○ | 5/10 |

Note:3 Carrier Adhesion

Table 3 shows evaluation results of magnetic reading with varied toner contents in the magnetic developers. High toner content provided high image density. In No. 31, read out error was not marked but carrier adhesion to the photoreceptor occurred. In No. 35, background fogging and read-out error occurred. Accordingly, toner content in magnetic developer is preferably 20 to 80 percent by weight.

Using the magnetic developer of the invention, not only general document and/or graphics can be doped, but also MICR characters can be developed with an excellent quality in MICR system. The MICR characters are not smeared or chipped, after rubbing the characters by a reader/sorter, so that a high recognition rate can be obtained.

What is claimed is:

1. A two-component magnetic developer for printing magnetic characters for magnetic ink character recognition, the developer comprising:

a magnetic toner containing a binder resin and a magnetic powder, the magnetic toner having magnetic powder of ($\sigma_r$) of 4 to 16 emu/g, and an average particle diameter of 5 to 15 $\mu$m; and a magnetic carrier of binder particles with magnetic powder dispersed in a resin binder, the magnetic powder and the resin binder being mechanically blended and pulverized to form a mixture with an average particle diameter of 5 to 60 $\mu$m, wherein the magnetic toner is 20 to 80 percent by weight of the developer and the magnetic carrier is the balance and wherein the magnetic carrier of binder particles with magnetic powder dispersed in a resin binder has the triboelectric charge of the same polarity as the toner and the average particle diameter of 1.5 to 4 times that of the toner.

7. The two-component magnetic developer as set forth in claim 6, wherein magnetization $\sigma_{1000}$ of the magnetic carrier in magnetic field of 1000 Oersteds is 30 to 50 emu/g.

8. The two-component magnetic developer as set forth in claim 7, wherein the magnetic toner contains a release agent of less than 10 percent by weight.

9. The two-component magnetic developer as set forth in claim 7, wherein the magnetic toner contains internal additives of 0.1 to 5 percent by weight as a lubricant agent.

10. The two-component magnetic developer as set forth in claim 7, wherein the magnetic toner contains external additives of 0.1 to 2 percent by weight as a lubricant agent.

* * * * *